US006273235B1

(12) United States Patent
Inoue

(10) Patent No.: US 6,273,235 B1
(45) Date of Patent: Aug. 14, 2001

(54) FLEXIBLE DRIVE SYSTEM FOR ESCALATORS OR MOVING WALKS

(75) Inventor: Takao Inoue, Lebanon, OH (US)

(73) Assignee: Fujitec America, Inc., Lebanon, OH (US)

( * ) Notice: Subject to any disclaimer, the term of this patent is extended or adjusted under 35 U.S.C. 154(b) by 0 days.

(21) Appl. No.: 09/191,086

(22) Filed: Nov. 12, 1998

(51) Int. Cl.[7] ..... B66B 21/00
(52) U.S. Cl. ..... 198/330
(58) Field of Search ..... 198/330, 329, 198/322

(56) References Cited

U.S. PATENT DOCUMENTS 1,023,443 * 4/1912 Seeberger ..... 198/330
3,365,051 * 1/1968 Mullis et al. ..... 198/330
3,677,388 * 7/1972 Boltrek et al. ..... 198/330
4,231,452 * 11/1980 Kraft ..... 198/330
4,535,880 * 8/1985 Boltrek ..... 198/330
4,775,044 * 10/1988 Holfling ..... 198/330
5,224,580 * 7/1993 Nurnberg et al. ..... 198/330
6,092,639 * 7/2000 Reo ..... 198/330

* cited by examiner

*Primary Examiner*—Douglas Hess
(74) *Attorney, Agent, or Firm*—Frost Brown Todd LLC

(57) ABSTRACT

An improved flexible drive assembly for escalators and moving walks is provided. The improved drive assembly includes a substantially horizontally disposed motor. The drive assembly of the present invention further includes a substantially horizontally disposed single-stage worm gear input shaft arranged perpendicularly with a main step band sprocket shaft. The worm gear input shaft, in turn, drives a horizontal output shaft disposed in parallel fashion to the main step band sprocket shaft. One or more drive chains each link corresponding output shaft gears with corresponding main drive sprocket gears disposed on the main step band sprocket shaft. Step chain sprockets of larger diameter than the main drive sprockets are disposed adjacent to and inwardly of a corresponding main drive sprocket. These step band sprockets engage the step band and drive it about its endless path.

32 Claims, 7 Drawing Sheets

FLEXIBLE DRIVE SYSTEM FOR ESCALATORS OR MOVING WALKS

TECHNICAL FIELD

The present invention generally relates to a drive system for escalators or moving walk systems. More particularly, this invention relates to an improved flexible drive assembly capable of being disposed and installed in various locations and positions outside or inside the region of reversal of the escalator or moving walk.

BACKGROUND OF THE INVENTION

For purposes of an exemplary showing, the present invention will be described in its application to moving walks or escalators. As will be abundantly apparent to one skilled in the art, the teachings of the present invention are equally apparent to one skilled in the art, the teachings of the present invention are equally applicable to moving walks of the type comprising an endless procession of tread segments or pallets or belts moving between a pair of balustrade skirts.

As is well known in the art, a typical escalator or moving walk includes a conveyor portion for transporting passengers between a first landing and a second landing. The transport conveyor is of the endless type, having an articulated belt which is driven about a closed path or loop. The transport conveyor typically includes an upper load bearing run upon which passengers stand while being transported between the landings. The conveyor further includes a lower return run and first and second turn-around portions that connect the load bearing and the return runs.

A typical escalator comprises a plurality of steps which are operatively joined together in a pivotal fashion to form an endless loop of steps. Each step typically comprises a pair of side frames which supports a substantially planar tread and an arcuate riser. Each step has a first pair of shaft mounted wheels located to either side thereof and substantially beneath the riser. Each step has a second pair of shaft mounted wheels located near the opposite end of the tread remote from the riser. The shaft of the second set of wheels is also operatively attached to a pair of drive chains which pass over an upper pair of corresponding sprocket wheels at the upper end of the escalator and a corresponding lower pair of sprocket wheels at the lower end of the escalator. Typically, one of the upper and lower sprocket wheel pairs is an idler pair, and the other of the upper and lower sprocket wheel pairs is a driven pair, driving the pair of chains and the plurality of steps attached thereto. Typically, the set of tracks for the first set of wheels is so configured that it assures that the treads of the steps in the passenger carrying flight are horizontal. The set of tracks for the first set of wheels is configured to assure that the treads assume a continuous belt-like configuration about the upper and lower sprocket wheel sets and throughout the length of the return flight. Typically, the second set of shaft mounted wheels rides upon its own separate set of tracks.

It is common practice to drive a passenger conveyor from one end or the other, with escalators usually being driven from the upper terminal. As mentioned previously, driving by means of one or more sprocket wheels in the turn-around portion has been widely used. Typical drive units include one or more drive motors and gear reducers operably linked to sprocket wheels which engage and propel the conveyor drive chains which in turn drive the endless belt about its guided path.

There are several different drive arrangements in the art that have been used to drive passenger moving walks and escalators. One such arrangement comprises a vertically or horizontally disposed electric motor having an input shaft being perpendicular to the sprocket wheel drive shaft. This arrangement is commonly used in order to transmit the necessary drive power and to achieve the necessary reduction in the speed of rotation by means of a worm gearing. Although the step-down ratio and the improved operational noise-levels achieved by operation of this drive configuration are desirable, there remains an undiminished need for a drive assembly exhibiting improved flexibility and a smaller structural size with the same, or possibly even increased, capacity for electric power. Given the limited amount of space that is available inside the area of return of the step band or truss envelopment, the orientation and height of this type of drive system limits its retrofit capabilities and makes it incompatible with many escalator or moving walk systems where available space for drive assemblies is somewhat limited.

The somewhat lower efficiency of the vertical worm gearing assembly and the cumbersome and limiting configuration of the vertical drive system in particular provided incentive to look for further solutions and improved drive means. One such alternative configuration is a horizontally disposed drive motor located within the region of reversal and inside the rotating step or pallet belt. A typical drive assembly of this configuration includes a drive shaft and planetary gearing arranged with axes parallel to the axes of the step or pallet drive shaft. Typically, a transmission output gear on the motor drive shaft is in direct engagement with a gear on the shaft of the step or pallet drive. Although this arrangement is somewhat more compact than a vertically disposed worm gear drive arrangement, it is not very flexible in that it must be disposed near the sprocket assembly so that the various gears are in communication.

It is clear that a need exists for an improved flexible drive assembly for escalators and moving walks capable of being disposed in a variety of configurations. Such a drive assembly would be relatively compact as compared with prior art systems and would achieve improved space utilization without sacrificing adequate power output.

SUMMARY OF THE INVENTION

In accordance with the purposes of the present invention, and as shown in the accompanying figures, an improved flexible drive assembly for escalators and moving walks is provided. The improved drive assembly comprises a substantially horizontally disposed motor. The drive assembly of the present invention further includes a substantially horizontally disposed single-stage worm gear input shaft arranged perpendicularly with the main step band sprocket shaft. This worm gear input shaft, in turn, drives a horizontal output shaft disposed in parallel fashion to the main step band sprocket shaft. This configuration results in a more compact drive assembly as compared with prior art drive motors and, as a result, the drive assembly of the present invention may be used in a variety of situations where only minimal space is available near the top area of return within which to install the drive assembly.

A pair of drive chains link a pair of output shaft gears with corresponding main drive sprocket gears disposed on opposite ends of the main step band sprocket shaft. A pair of step chain sprockets of larger diameter than the main drive sprockets are each disposed adjacent to and inwardly of a corresponding main drive sprocket. These step band sprockets engage the step band and drive it about its endless path. Advantageously, the provision of drive sprockets on both ends of the output shaft doubles the safety factor of the system. Specifically, because this drive system utilizes a dual chain configuration, the need for an emergency brake is eliminated as it is statistically unlikely that both chains would simultaneously fail.

The drive system of the present invention is capable of being disposed in a variety of positions both inside and outside of the step belt and inside and outside of the truss envelopment. As it should be appreciated, this allows for space saving within the total escalator system area and more easily allows for an escalator drive to be retrofitted into a relatively confining space.

Another advantage of the drive assembly of the present invention results from utilizing chains to connect the sprocket and step belt drive shaft with the output shaft. This further adds to the flexibility of the system as the drive may be disposed in a number of positions about the step band drive shaft as shown in the figures. Unlike prior art gear-to-gear transmission of drive power, the configuration of the present invention also allows the step band drive shaft and the output drive shaft to be sufficiently separated to allow for easier maintenance access to the various parts of the assembly.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views. As indicated above, while the teachings of the present invention are applicable to segmented moving walks and the like, for purposes of an exemplary showing, it will be described in detail in terms of its application to escalators.

Figure 1:
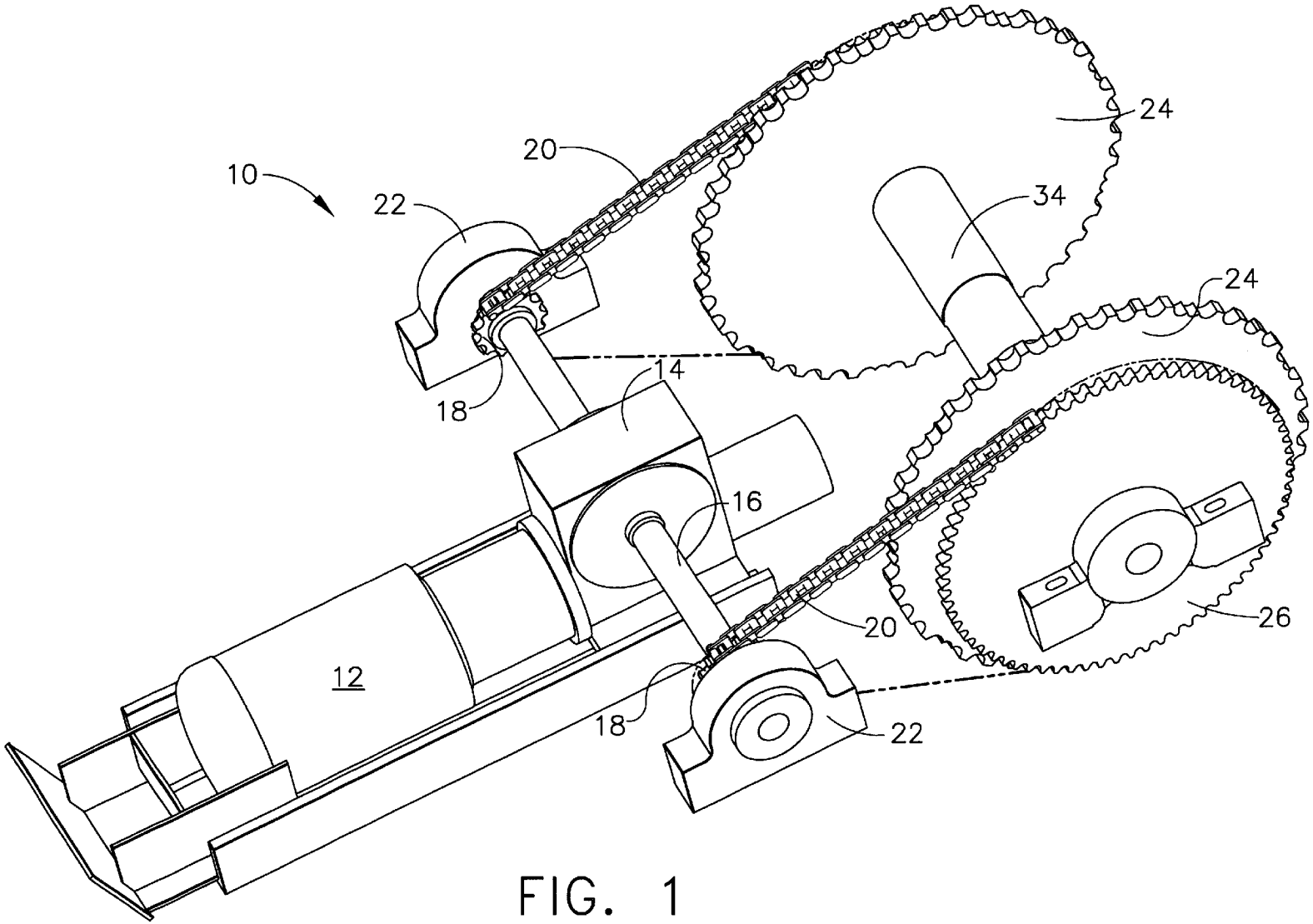
FIG. 1 is a perspective view of the escalator drive assembly of the present invention.

Referring now to the drawings, FIG. 1 shows a flexible drive system for a transport conveyor of an escalator or moving walk, generally designated by the numeral 10. The drive system 10 includes an output shaft 16 adapted to be driven by a motor 12. The drive system further includes a main drive shaft 34 that is preferably disposed substantially parallel with and spaced apart from the output shaft 16.

Figure 2:
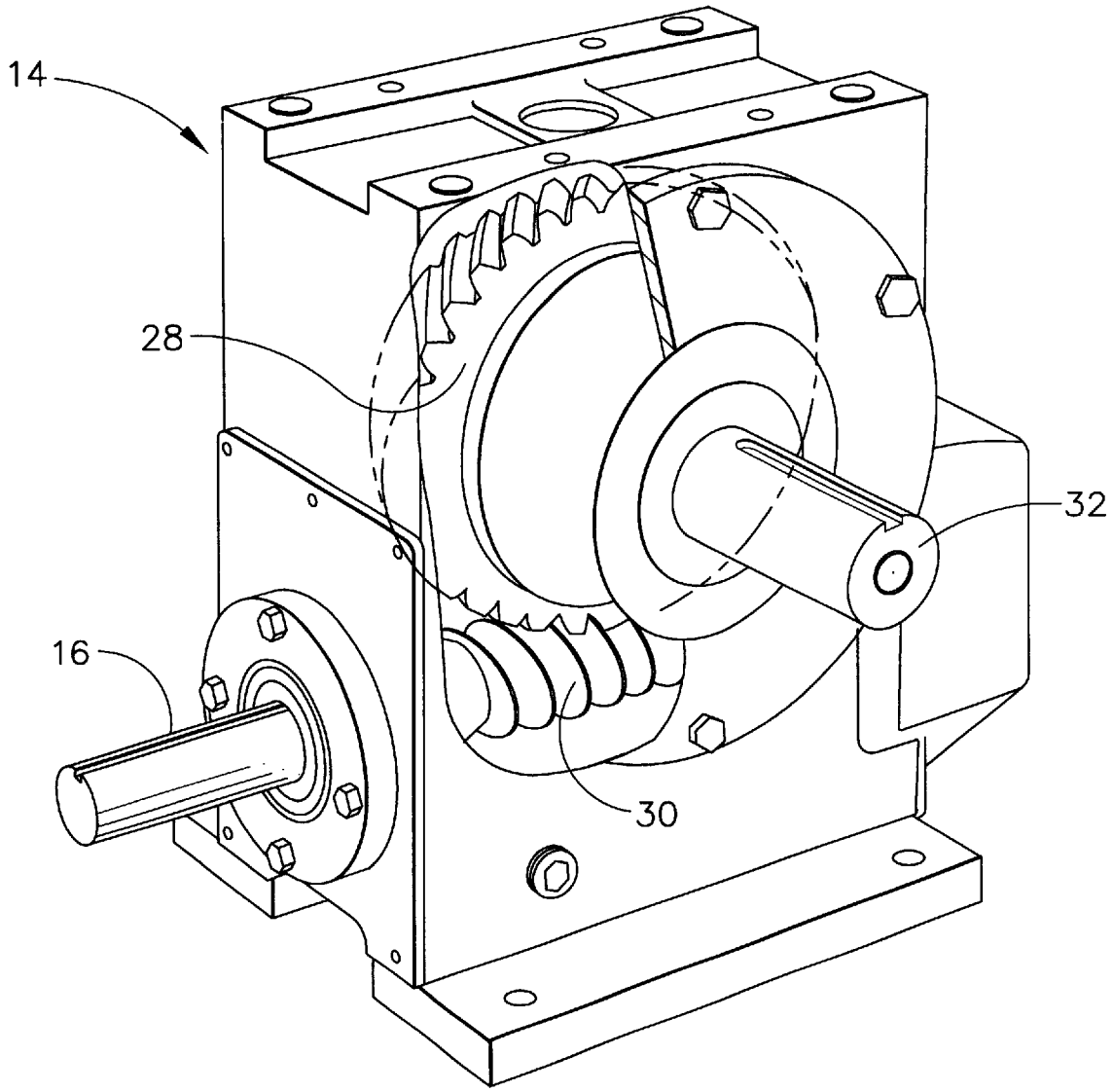
FIG. 2 is a partially cutaway perspective view of the worm gear drive of the escalator drive assembly of the present invention.

As shown in FIG. 2, the motor 12 preferably includes a motor output shank 32 that is disposed substantially perpendicularly with the output shaft 16 and the main drive shaft 34. Preferably, the output shank 32 disposed along and aligned with the long axis of the motor 12. A worm gear 28 is preferably disposed in a housing 14 on the motor output shank 32 where it is in communication with a worm 30. The worm 30 is preferably integral with a segment of the output shaft 16 so that the worm gear 28 engages the worm 30 when the motor 12 drives the motor output shank 32 which in turn drives the output shaft 16.

The output shaft 16 also preferably includes hanging support brackets 22. Preferably, the support brackets 22 are located substantially adjacently with the output shaft drive sprockets 18 on the output shaft 16. The extra support provided by the support brackets 22 advantageously reduces the force on the motor 12 itself and its associated mounting support requirements.

Figure 3:
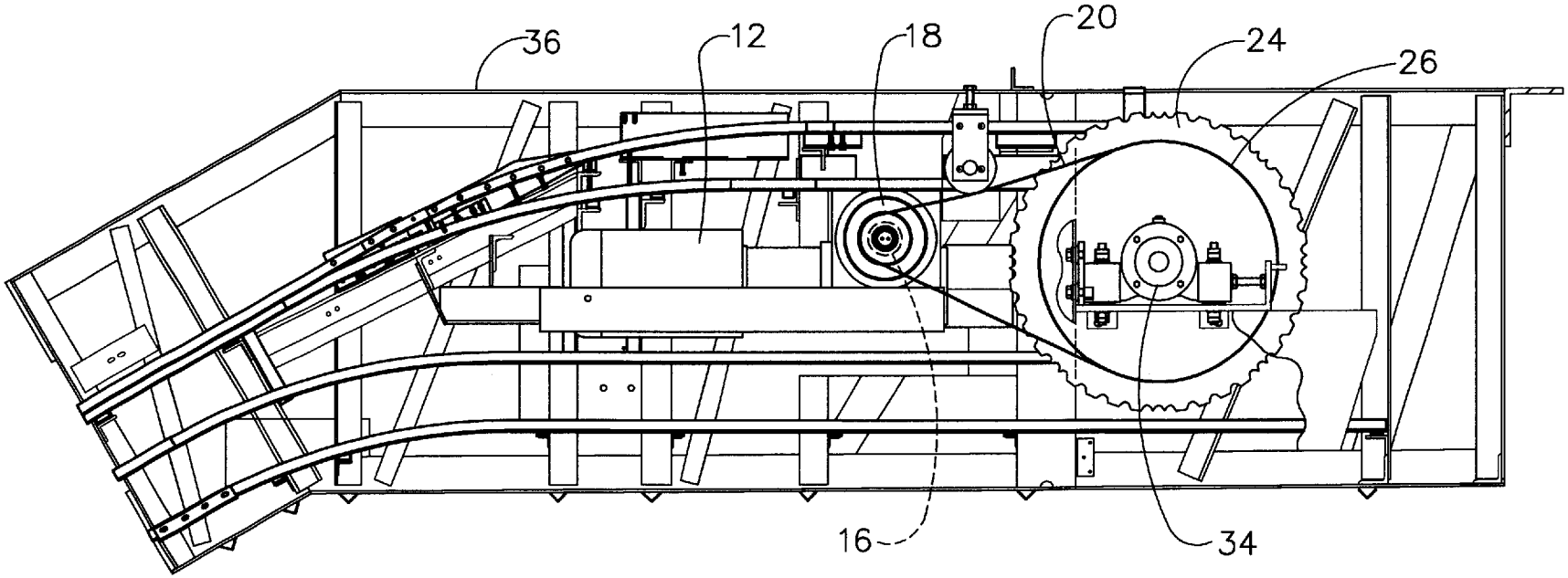
FIG. 3 is a cutaway side view of an upper truss frame of an escalator incorporating the escalator drive assembly of the present invention.
Figure 4:
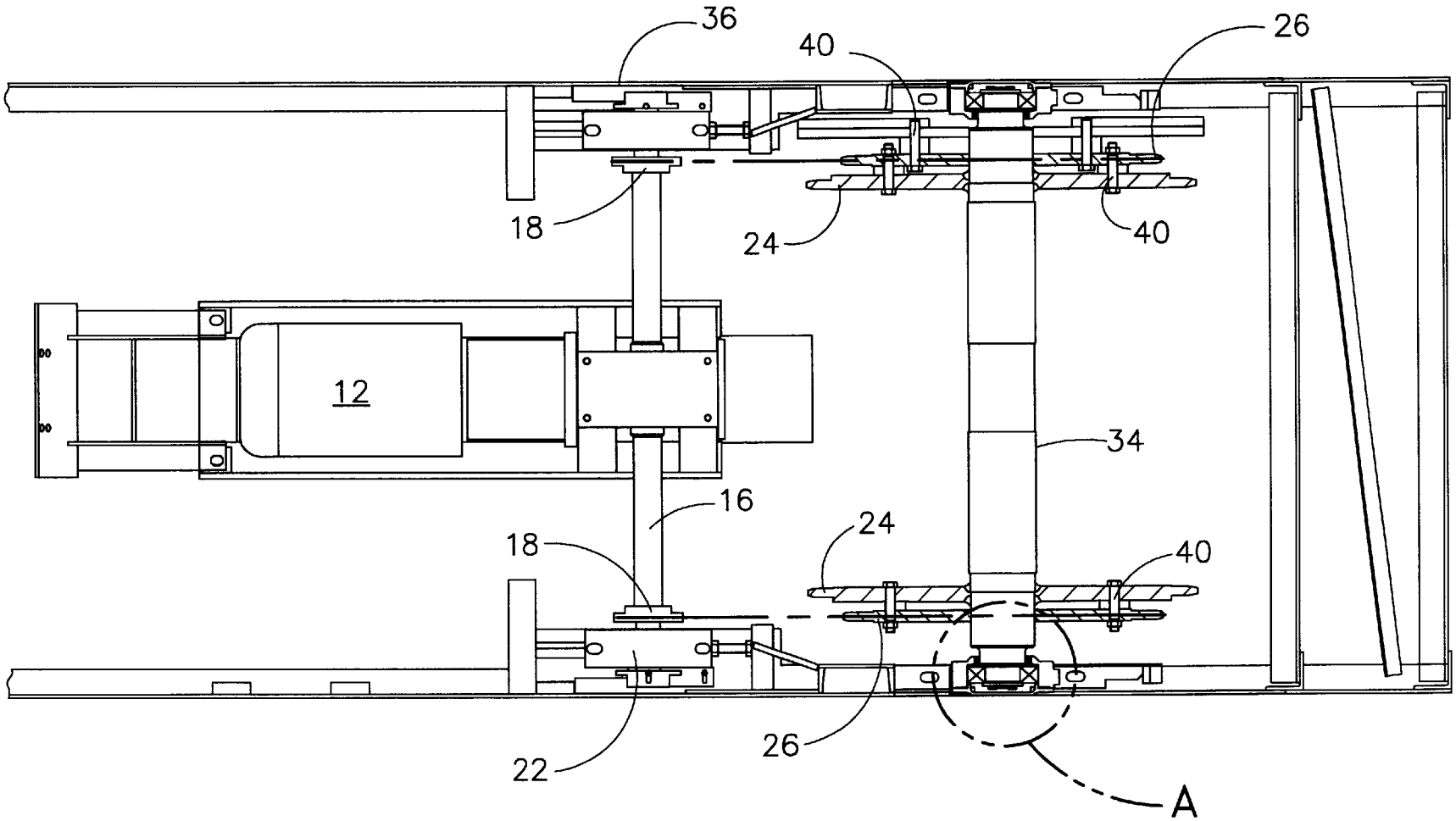
FIG. 4 is an overhead view of the escalator drive assembly of the present invention.

As best shown in FIGS. 1, 3, and 4, the flexible drive system 10 further includes first and second output shaft sprockets 18 disposed about the output shaft 16. First and second main drive sprockets 26 are disposed about the main drive shaft 34 and are substantially aligned with a corresponding output shaft sprocket 18. Preferably, first and second endless drive chains 20 link each of the aligned output shaft sprockets 18 with a corresponding main drive sprocket 26. Flexibility is achieved by the flexible drive assembly of the present invention by using the drive chains 20 to provide the power transmission to the main drive shaft 34.

The provision of more than one drive chain 20 advantageously doubles the safety factor of the escalator using the drive assembly 10 of the present invention. Specifically, if one chain 20 were to fail, another chain would still be in place to prevent excess slippage of the escalator belt thus reducing the need for an external emergency brake. Although it is preferred that pair of drive chains 20 be provided to link to output shaft sprockets 18 with corresponding main drive sprocket 26, it is within the scope of the present invention to provide a drive assembly 10 incorporating only one drive chain 20 linking a single output shaft with a single main drive sprocket.

Because the output shaft may be linked to the main drive by chains 20 of the appropriate length, the output shaft 16 need not be adjacent to, or even in close proximity with, the main drive shaft 34. This also advantageously reduces the need for space in the area of return of the escalator in that a significant portion of the drive assembly 10 may be disposed outside of the area of return, or even outside the escalator upper truss 36. The configuration of the present invention also allows for easier maintenance access to the part of the drive assembly being serviced. Specifically, the design of the present drive system allows for independent repair, maintenance, and replacement with only minimal system-wide interference as compared with prior art drive systems.

Figure 6:
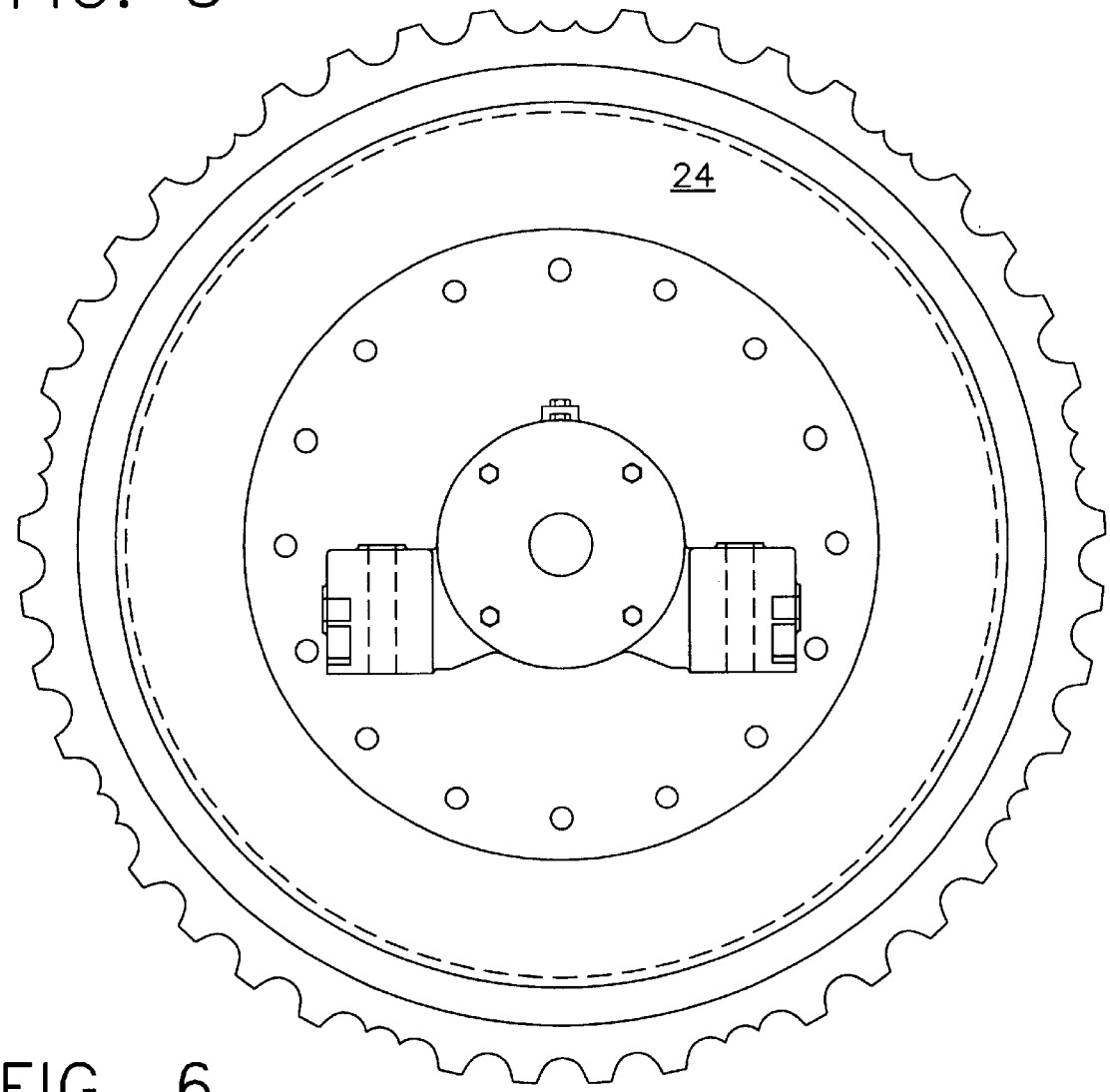
FIG. 6 is a side plan view of a preferred embodiment of the transport conveyor sprocket of the escalator drive assembly of the present invention.
Figure 7A:
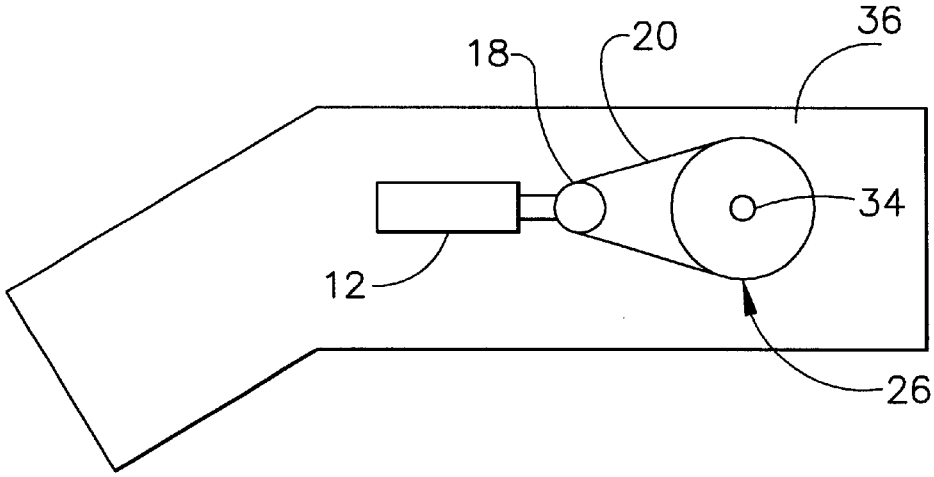
FIG. 7*a* is a partially diagrammatic view of the escalator drive assembly of the present invention shown disposed within the area of return of the step band and within the truss envelopment.
Figure 7B:
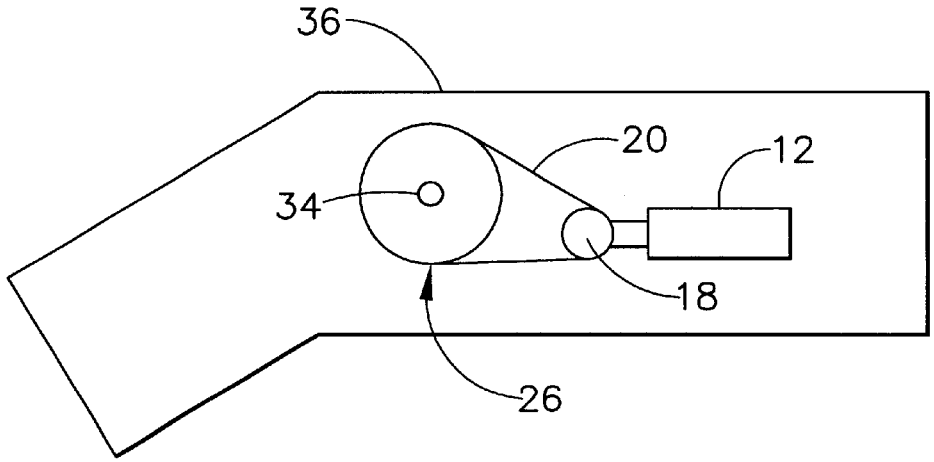
FIG. 7*b* is a partially diagrammatic view of the escalator drive assembly of the present invention shown disposed outside the area of return of the step band and within the truss envelopment.
Figure 7C:
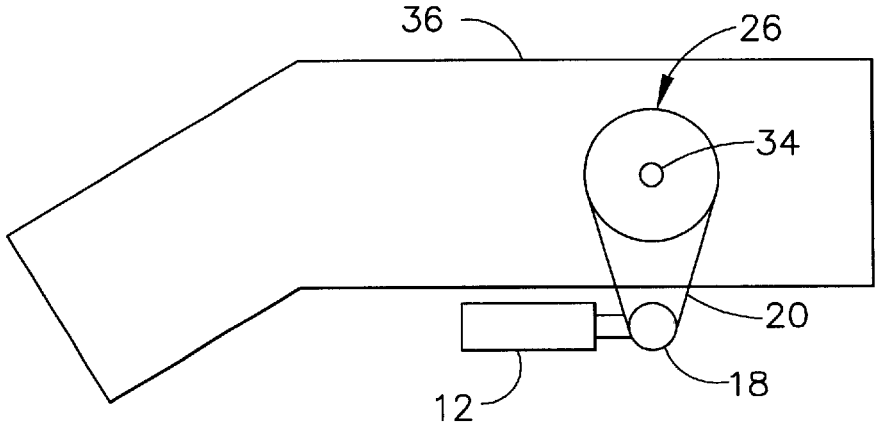
FIG. 7*c* is a partially diagrammatic view of the escalator drive assembly of the present invention shown disposed underneath the area of return of the step band and outside the truss envelopment.
Figure 7D:
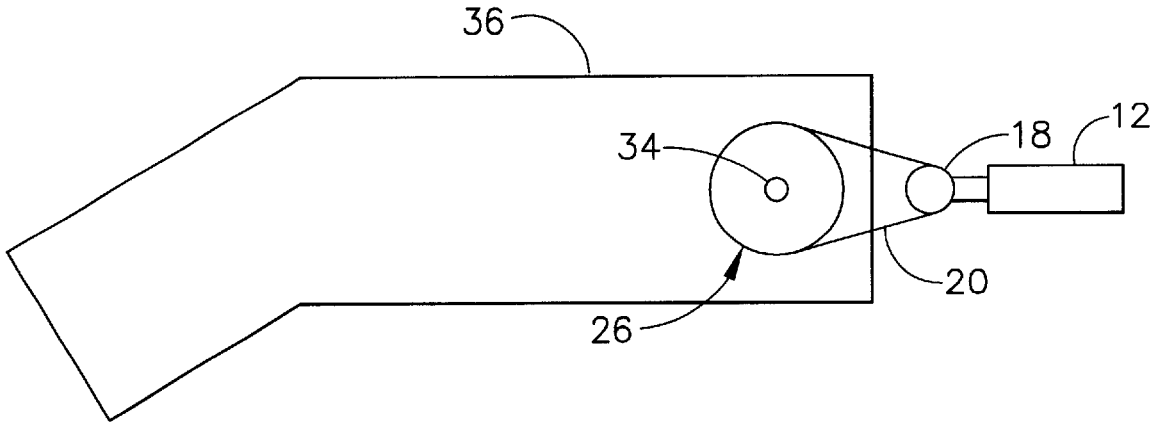
FIG. 7*d* is a partially diagrammatic view of the escalator drive assembly of the present invention shown disposed outside the truss envelopment and in front of the upper landing of the escalator.

First and second transport conveyor sprockets 34 are also provided on the main drive shaft 34. A detailed view of a transport conveyor sprocket is provided in FIG. 6. Preferably, the transport conveyor sprockets 24 are disposed substantially adjacently with a corresponding main drive sprocket 26 on the main drive shaft 34, as shown in FIGS. 1 and 4. The transport conveyor sprockets 24 are adapted to engage and drive the transport conveyor, or escalator step belt, about its endless path. Preferably, the transport conveyor sprockets 24 each engage a corresponding transport conveyor drive chain that are connected to the transport conveyor thus driving it about its path.

Figure 5:
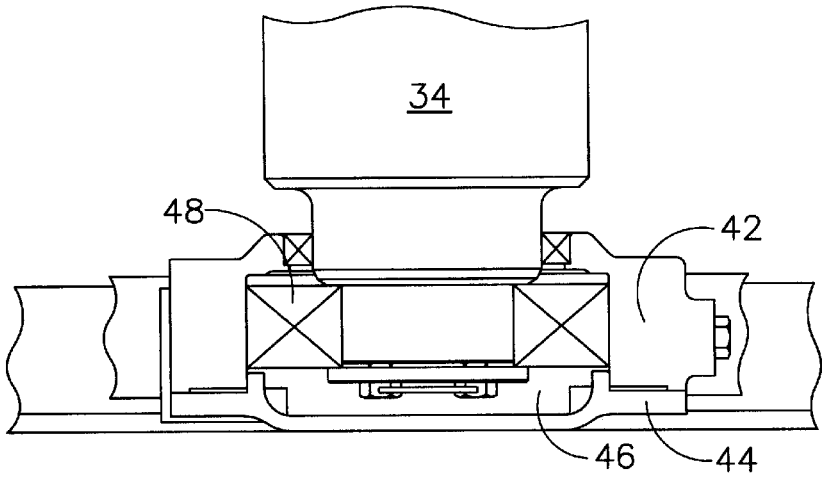
FIG. 5 is a cutaway view of the bearing housing of the main drive shaft of the escalator drive assembly of the present invention.

As shown in FIGS. 4 and 5, main drive shaft 34 may be supported by one or more roller bearings 48 mounted in a standard housing 42 with a cover 44. Industrial lubricant may be provided as needed in the chamber 46 to provide adequate lubrication to the bearings 48.

As best shown in FIG. 4, one or more bolts 40 may be provided to fixedly attach each main drive sprocket gear 26 with its neighboring transport conveyor sprocket 24 for additional stability and to maintain uniformity of rotation.

According to an important aspect of the invention, and as shown in FIGS. 7*a–d,* the flexible drive system 10 is adaptable in that the motor 12 may be installed either within or outside of the upper region of return of the escalator. Further, the motor 12 may be installed within or outside of the upper truss support frame 36. Preferably, and in order to add further flexibility to the drive system of the present invention, the output shaft 16 is capable of being disposed either substantially within or substantially outside of the upper truss support 36. As can be seen in FIGS. 7*a–d,* this flexibility allows for the flexible drive assembly 10 of the present invention to be disposed in many different configurations. Further, because the motor is preferably disposed perpendicularly with the output shaft, additional space savings is achieved. Accordingly, the flexible drive system 10 of the present invention is characterized by its ability to be implemented in situations where there are tight space constraints. This is an especially desirable feature when an escalator is being installed or retrofitted into an existing structure with limited available space.

The foregoing description of a preferred embodiment of the invention has been presented for the purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated.

What is claimed is:

1. A drive system for an escalator or moving walk, said drive system comprising:

(a) a transport conveyor;

(b) an escalator, said escalator comprising an upper truss support frame;

(c) an output shaft;

(d) a motor, said output shaft adapted to be driven by said motor, said motor further being adapted to be installed within or outside of said upper truss support frame;

(e) a main drive shaft, said main drive shaft being disposed substantially parallel with and spaced apart from said output shaft;

(f) first and second output shaft sprockets, each of said output shaft sprockets being disposed about said output shaft;

(g) first and second main drive shaft sprockets, each of said main drive shaft sprockets being disposed about said main drive shaft, each of said main drive shaft sprockets further being substantially aligned with a corresponding output shaft sprocket;

(h) first and second endless drive chains, each of said drive chains linking an output shaft sprocket with a corresponding main drive shaft sprocket; and (i) first and second transport conveyor sprockets, said transport conveyor sprockets being adapted to engage and drive said transport conveyor about a closed path, each of said first and second transport conveyor sprockets being connected with a corresponding one of said first and second main drive shaft sprockets by one or more connecting means.

2. The drive system of claim 1, wherein said transport conveyor has an upper region of return, and wherein said motor is adapted to be installed either within or outside of said upper region of return.

3. The drive system of claim 2, wherein said output shaft is adapted to be installed either within or outside of said upper region of return.

4. The drive system of claim 2, wherein said output shaft is capable of being disposed both substantially within and substantially outside of said upper truss support frame.

5. The drive system of claim 1, wherein said motor further comprises a motor output shank, said motor output shank being disposed substantially in alignment with a long axis of said motor, said motor output shank being further disposed substantially perpendicularly with said output shaft and said main drive shaft.

6. The drive system of claim 5, wherein a worm gear is disposed about said motor output shank, and wherein a portion of said output shaft comprises a worm, said motor output shank being disposed in such a manner that said worm gear is in communication with said worm, whereby said worm gear engages said worm when said motor drives said motor output shank thereby driving said output shaft.

7. The drive system of claim 1, wherein said main drive sprockets are of a lesser diameter than said transport conveyor sprockets.

8. The drive system of claim 7, wherein said output shaft sprockets are of a lesser diameter than said main drive sprockets.

9. The drive system of claim 8, wherein said first and second output shaft sprockets are disposed substantially equidistantly from the midpoint of said output shaft.

10. The drive system of claim 9, wherein said first and second main drive shaft sprockets are disposed substantially equidistantly from the midpoint of said main drive shaft.

11. The drive system of claim 10, wherein said transport conveyor sprockets are disposed substantially equidistantly from the midpoint of said main drive shaft.

12. The drive system of claim 11, wherein said motor is disposed substantially horizontally.

13. The drive system of claim 12, wherein said long axis of said motor is substantially perpendicular with said output shaft and said main drive shaft.

14. The drive system of claim 13, wherein said output shaft comprises one or more hanging shaft support brackets.

15. The drive system of claim 1, wherein said transport conveyor sprockets are disposed between said main drive shaft sprockets.

16. The drive system of claim 1, wherein each said transport conveyor sprocket engages a corresponding transport conveyor drive chain, and wherein said transport conveyor drive chains are connected with said transport conveyor.

17. The drive system of claim 1 wherein said one or more connecting means comprises a plurality of bolts.

18. The drive system of claim 17 wherein each of said bolts are disposed at a location between the center and the outer edge of the transport conveyor sprocket to which it is attached.

19. A drive system for an escalator or moving walk, said drive system comprising:

(a) a transport conveyor;

(b) an escalator, said escalator comprising an upper truss support frame;

(c) an output shaft, (d) a motor, said output shaft adapted to be driven by said motor, said motor further being adapted to be installed within or outside of said upper truss support frame;

(e) a main drive shaft, said main drive shaft being disposed substantially parallel with and spaced apart from said output shaft;

(f) one or more output shaft sprockets, each of said one or more output shaft sprockets being disposed about said output shaft;

(g) one or more main drive shaft sprockets, each of said one or more main drive shaft sprockets being disposed about said main drive shaft, each of said one or more main drive shaft sprockets further being substantially aligned with a corresponding output shaft sprocket;

(h) one or more endless drive chains, each of said one or more drive chains linking an output shaft sprocket with a corresponding main drive shaft sprocket; and (i) one or more transport conveyor sprockets, said one or more transport conveyor sprockets being adapted to engage and drive said transport conveyor about a closed path, each of said first and second transport conveyor sprockets being connected with a corresponding one of said first and second main drive shaft sprockets by one or more connecting means.

20. The drive system of claim 19, wherein said transport conveyor has an upper region of return, and wherein said motor is adapted to be installed either within or outside of said upper region of return.

21. The drive system of claim 20, wherein said output shaft is capable of being disposed both substantially within and substantially outside of said upper truss support frame.

22. The drive system of claim 20, wherein said output shaft is adapted to be installed either within or outside of said upper region of return.

23. The drive system of claim 19, wherein said motor further comprises a motor output shank, said motor output shank being disposed substantially in alignment with a long axis of said motor, said motor output shank being further disposed substantially perpendicularly with said output shaft and said main drive shaft.

24. The drive system of claim 23, wherein a worm gear is disposed about said motor output shank, and wherein a portion of said output shaft comprises a worm, said motor output shank being disposed in such a manner that said worm gear is in communication with said worm, whereby said worm gear engages said worm when said motor drives said motor output shank thereby driving said output shaft.

25. The drive system of claim 19, wherein said one or more main drive sprockets are of a lesser diameter than said one or more transport conveyor sprockets.

26. The drive system of claim 25, wherein said one or more output shaft sprockets are of a lesser diameter than said one or more main drive sprockets.

27. The drive system of claim 25, wherein said motor is disposed substantially horizontally.

28. The drive system of claim 27, wherein said long axis of said motor is substantially perpendicular with said output shaft and said main drive shaft.

29. The drive system of claim 28, wherein said output shaft comprises one or more hanging shaft support brackets.

30. The drive system of claim 19, wherein each said one or more transport conveyor sprocket engages a corresponding transport conveyor drive chain, and wherein said transport conveyor drive chains are connected with said transport conveyor.

31. The drive system of claim 19 wherein said one ore more connecting means comprises a plurality of bolts.

32. The drive system of claim 31 wherein each of said bolts are disposed at a location between the center and the outer edge of the transport conveyor sprocket to which it is attached.

* * * * *